US008164597B2

(12) United States Patent
Watanabe

(10) Patent No.: US 8,164,597 B2
(45) Date of Patent: Apr. 24, 2012

(54) COLOR CONVERSION CIRCUIT AND METHOD OF COLOR CONVERSION USING INTERPOLATION FROM CONVERSION COEFFICIENTS SOME OF WHICH ARE SUBSTITUTED

(75) Inventor: Yoshinori Watanabe, Chiba (JP)

(73) Assignee: Kawasaki Microelectronics, Inc., Chiba (JP)

( * ) Notice: Subject to any disclaimer, the term of this patent is extended or adjusted under 35 U.S.C. 154(b) by 1015 days.

(21) Appl. No.: 12/078,444

(22) Filed: Mar. 31, 2008

(65) Prior Publication Data

US 2008/0252657 A1 Oct. 16, 2008

(30) Foreign Application Priority Data

Apr. 10, 2007 (JP) ..... 2007-102826

(51) Int. Cl.
*G09G 5/02* (2006.01)

(52) U.S. Cl. ..... 345/603; 345/419; 345/593; 345/591; 345/604; 345/690; 382/162; 382/164; 382/167; 358/515; 358/520; 358/534

(58) Field of Classification Search ..... 345/419, 345/591, 593, 603, 604, 690; 382/164, 162, 382/167; 358/520, 515, 534
See application file for complete search history.

(56) References Cited

U.S. PATENT DOCUMENTS 4,511,989 A 4/1985 Sakamoto
7,728,847 B2 6/2010 Koyama

FOREIGN PATENT DOCUMENTS

GB 1 595 122 8/1981
JP A-2004-179819 6/2004

*Primary Examiner* — Andrew Wang
*Assistant Examiner* — Abderrahim Merouan
(74) *Attorney, Agent, or Firm* — Oliff & Berridge, PLC

(57) ABSTRACT

Exemplary embodiments of color conversion circuits and color conversion methods convert input color data into output color data. The input color data is positioned in a three-dimensional color space, which is divided into a plurality of unit cubes each having a fixed dimension. The input color data is converted by performing interpolations using conversion coefficients at vertexes of the unit cube within which the input color data is positioned. When the input color data is positioned on a gray axis of the color space, a substitution circuit substitutes some of the conversion coefficients such that the interpolation becomes a linear interpolation. As a result, it is assured that input color data positioned on the gray axis is converted to gray output color data.

18 Claims, 6 Drawing Sheets

COLOR CONVERSION CIRCUIT AND METHOD OF COLOR CONVERSION USING INTERPOLATION FROM CONVERSION COEFFICIENTS SOME OF WHICH ARE SUBSTITUTED

This application claims benefit of Japanese Patent Application No. JP-A-2007-102826. The disclosure of the prior application is hereby incorporated by reference herein in its entirety.

BACKGROUND

This application relates to color conversion circuits and color conversion methods that convert input color data to generate output color data by performing interpolations from conversion coefficients stored in a three-dimensional look-up table (LUT).

In general, pictures output from image output devices, such as displays and printers, have specific characteristics depending on the liquid-crystal devices, ink-jet devices, or the like, that generate the pictures or images from data. Accordingly, means to convert input data to output data to be supplied to the liquid-crystal devices, ink-jet devices, or the like, in accordance with their characteristics are required. Specifically, output devices that output full-color pictures or images need to compensate for their characteristics in three primary colors of, for example, R (Red), G (Green), and B (Blue). Thus, output devices may include electric circuitries that perform conversions of the input color data to generate the output color data in accordance with their characteristics in all primary colors.

Conversions from input color data to output color data may be performed by, for example, i) preparing a mathematical formula (or function) for calculating the values of output color data from the values of input color data, or ii) providing a memory (or table) that stores the values of output color data corresponding to respective values of input color data. In particular, the latter method has an advantage that the values of output color data may be flexibly changed depending on the characteristics of the output devices, input data, preference of the users, or the like. Such color conversion functions have been implemented in television sets, digital still cameras, printers, or the like.

Recently, semiconductor integrated circuit devices that embody above-described color conversion functions are often incorporated in digital television sets that utilize liquid-crystal display or plasma display technologies, in order to compensate for the characteristics of these display technologies and to improve the image quality.

In actual color conversions, however, values of output color data cannot be expressed by a simple function of the values of input color data in, for example, RGB form. On the other hand, storing values of each output color data corresponding to values of each input color data (or coordinates of each input color data in the color space) in a memory requires a large memory capacity. Further, accesses to a memory having such a large capacity require long times. Accordingly, it is proposed to divide the three-dimensional color space, such as RGB color space, into a plurality of unit cubes having fixed dimensions, and to store conversion coefficients only at vertexes of the plurality of unit cubes in a LUT.

FIG. 7 schematically shows an exemplary LUT where coordinates in RGB color space of input color data in R, G, and B primary colors are expressed with 10-bit values R [9:0], G [9:0], and B [9:0]. That is, in the exemplary LUT shown in FIG. 7, input color data has value in each R, G, and B primary color ranging from 0 to 1023. In the exemplary LUT shown in FIG. 7, the RGB three-dimensional color space is divided into 512 unit cubes each having a dimension of 128 (R)×128 (G)×128 (B). The exemplary LUT stores conversion coefficients at vertexes of respective 512 unit cubes.

By using the LUT described above, an average value of conversion coefficients at vertexes around the input color data may be calculated. The average value thus calculated is often utilized as the value of output color data when converting luminance information alone, or when expressing color data with a redundant system with more than three primary colors like the case of a printer. However, when both input and output color data are in the same color space, such as RGB color space, as in the case of an image-quality improving circuit for TVs, for example, it is desirable that values in respective primary colors can be converted independently. Accordingly, as shown in FIG. 8, an interpolation is performed independently for each of RGB color values from conversion coefficients at eight vertexes of a unit cube in which the input color data is positioned FIG. 8 shows one of the unit cubes having vertexes S0, S1, S2, S3, S4, S5, S6, and S7, and input color data positioned within the unit cube. In FIG. 8, vertex S3, which adjoins the vertexes S0, S2, and S7, is on the rear side of the sheet, and is not shown. The input color data has values (or coordinates) R, G, and B in respective primary colors. In other words, the coordinates (R, G, B) define the position of the input color data in the RGB color space.

When the input color data does not match any of the vertexes S0 to S7 of the unit cube, the unit cube is divided into 8 regions (rectangular parallelepipeds) A to H, each sharing the input color data (R, G, B) as a vertex. In FIG. 8, the region E is located on the rear side of the sheet, and is not shown. The region E is a rectangular parallelepiped having the vertex S3 and the input color data (R, G, B) on either end of its diagonal line. In a conventional color conversion method, an interpolation from the conversion coefficients at the vertexes S0 to S7 by using volumes of the eight divided regions (rectangular parallelepipeds) is performed to generate output color data. See, for example, British Patent No. 1595122 (Patent Document 1), which is incorporated by reference in its entirety.

However, a balance between the values in RGB primary colors may be changed by the above-described interpolation technique. That is, even if input color data is gray (achromatic) with equal R, G, and B primary color values, output color data after the conversion may be non-gray (chromatic) with non-equal primary color values. Because human eyes are sensitive between gray (achromatic) and non-gray (chromatic) colors, such change by the conversion may be viewed as a non-natural change of the image that lacks continuity of color.

In order to address the above-described problem, Japanese Laid-open Patent 2004-179819 (Patent Document 2), which is incorporated by reference in its entirety, discloses a color conversion processing apparatus, a color conversion processing program and a color conversion processing method.

Patent Document 2 proposed to divide the unit cube into a plurality of regions and to perform interpolations using different interpolation equations for respective regions. However, because the color conversion processing apparatus disclosed in Patent Document 2 employs different interpolation equations for respective regions, a plurality of interpolation circuits is required for performing interpolations using respective interpolation equations. As a result, the size of circuitry increases.

SUMMARY

This application discloses color conversion circuits and color conversion methods that convert input color data to output color data such that gray input color data is properly converted to gray output color data without increasing the size of circuitry. Further, this application discloses color conversion circuits and color conversion methods that are capable of maintaining continuity between different output color data converted from different input color data within a unit cube on the gray axis of the color space without increasing the size of circuitry. Still further, this application discloses color conversion circuits and color conversion methods that are capable of maintaining continuity between output color data converted from input color data within a unit cube on the gray axis and output color data converted from input color data within an adjoining unit cube without increasing the size of circuitry.

Various exemplary embodiments provide color conversion circuits for converting input color data into output color data. The input color data is positioned in a three-dimensional color space, which is divided in a plurality of unit cubes having a fixed dimension, at a position specified by coordinates of the input color data. The conversion circuit includes: a three-dimensional look-up table that stores conversion coefficients at respective vertexes of the plurality of unit cubes; a substitution circuit that reads conversion coefficients at vertexes of one of the unit cubes in which the input color data is positioned from the three-dimensional look-up table and performs a substitution of some of the conversion coefficients read from the look-up table with substitute conversion coefficients expressed by other ones of the conversion coefficients read from the look-up table; and an interpolation circuit that performs an interpolation from the conversion coefficients after the substitution to generate converted coordinates of the output color data.

According to various exemplary embodiments, the interpolation uses volumes of rectangular parallelepipeds that divide the one of the unit cubes such that each of the rectangular parallelepipeds shares the input color data as a vertex, and when the one of the unit cubes has a diagonal line placed on a gray axis of the color space and the input color data is positioned on the diagonal line, the substitution circuit performs the substitution such that the interpolation becomes a linear interpolation between conversion coefficients at vertexes on either end of the diagonal line. Alternatively, according to other various exemplary embodiments, when the one of the unit cubes has a diagonal line placed on a gray axis of the color space, the substitution circuit selects the some of the conversion coefficients to be substituted depending on a position of the input color data within the one of the unit cubes, and the interpolation circuit performs the interpolation using a single interpolation expression irrespective of the position of the input color data within the one of the unit cubes.

According to still other various exemplary embodiments, the input color data may include a first input color data positioned on the diagonal line and a second input color data positioned within the one of the unit cubes but not on the diagonal line, and the substitution circuit may perform the substitution such that a continuity between a first output color data converted from the first input color data and a second output color data converted from the second input color data is maintained.

According to still other various exemplary embodiments, the vertexes of the one of the unit cubes include, in addition to the vertexes on the either end of the diagonal line, six other vertexes grouped in two groups depending on which of the vertexes on the either end of the diagonal line is closer. The substitution circuit may select at least one of the vertexes from each of the two groups and perform the substitution of the conversion coefficients at the selected vertexes. Further, the substitution circuit may perform the substitution such that a sum of the conversion coefficients after the substitution at the vertexes in each of the two groups is expressed by a linear combination of the conversion coefficients at the vertexes on the either end of the diagonal line.

According to still other various exemplary embodiments, when the input color data is positioned within the one of the unit cubes but not on the diagonal line, the substitution circuit may select one of the vertexes furthest from the input color data from each of the two groups, and perform the substitution of the conversion coefficients at the selected vertexes.

According to still other various exemplary embodiments, when the input color data is positioned within the one of the unit cubes but not on the diagonal line, the substitution circuit may select the some of the conversion coefficients to be substituted depending on in which of six tetrahedrons, which divide the one of the unit cubes such that each of the tetrahedrons shares the diagonal line of the one of the unit cubes as an edge, the input color data is positioned. Further, one of the six tetrahedrons in which the input color data is positioned has diagonal lines of two adjoining surfaces of the one of the unit cubes as two edges, and the substitution circuit may select vertexes on either end of a furthest edge of the one of the unit cubes furthest from an edge of the one of the unit cubes shared by the adjoining surfaces and substitute the conversion coefficients at the selected vertexes.

Further, various exemplary embodiments provide a method of converting input color data into output color data. The method includes: receiving input color data positioned in a three-dimensional color space, which is divided in a plurality of unit cubes having a fixed dimension, at a position specified by coordinates of the input color data; reading conversion coefficients at vertexes of one of the unit cubes in which the input color data is positioned; performing a substitution of some of the read conversion coefficients with substitute conversion coefficients expressed by other ones of the read conversion coefficients; and performing an interpolation from the conversion coefficients after the substitution to generate converted coordinates of the output color data.

According to various exemplary embodiments, the interpolation uses volumes of rectangular parallelepipeds that divide the one of the unit cubes such that each of the rectangular parallelepipeds shares the input color data as a vertex, and when the one of the unit cubes has a diagonal line placed on a gray axis of the color space and the input color data is positioned on the diagonal line, the substitution is performed such that the interpolation becomes a linear interpolation between conversion coefficients at vertexes on either end of the diagonal line. Alternatively, according to other various exemplary embodiments, when the one of the unit cubes has a diagonal line placed on a gray axis of the color space, the substitution includes selecting the some of the conversion coefficients to be substituted depending on a position of the input color data within the one of the unit cubes, and the interpolation uses a single interpolation expression irrespective of the position of the input color data within the one of the unit cubes.

DETAILED DESCRIPTION OF EMBODIMENTS

According to various exemplary embodiments, a three-dimensional look-up table (LUT) stores conversion coefficients at respective vertexes of unit cubes that divide a three-dimensional color space with, for example, R, G, and B primary colors.

According to various exemplary color conversion methods, input color data is positioned in a three-dimensional color space at a position specified by the coordinates in three primary colors. Conversion coefficients at eight vertexes (or grid points) S0 to S7 of one of the unit cubes in which the input color data is positioned are read from the LUT. When it is detected that the input color data is positioned within a unit cube on the gray axis of the color space, which has a diagonal line placed on the gray axis, and that the input color data is positioned on the diagonal line placed on the gray axis, a substitution of some of the conversion coefficients is performed. Specifically, when the input color data is positioned on the diagonal line placed on the gray axis, some of the conversion coefficients read from the LUT are substituted such that the interpolation becomes a linear interpolation between the conversion coefficients at the vertexes on either end of the diagonal line that is placed on the gray axis.

Figure 8:
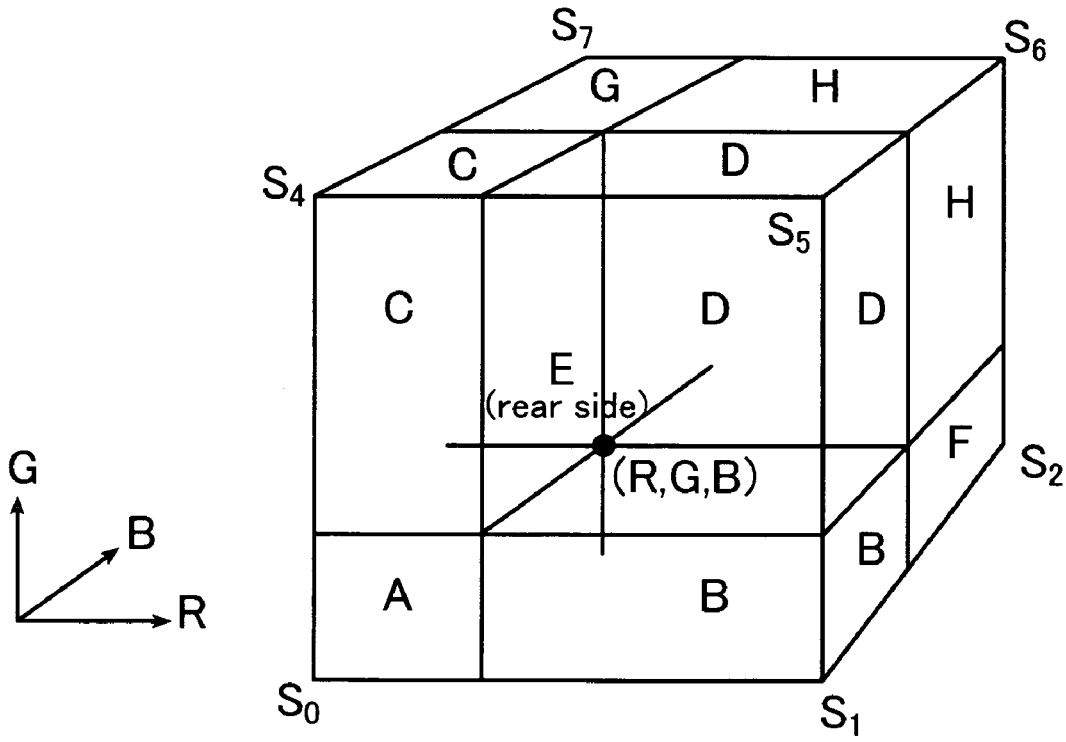
FIG. 8 Related Art
FIG. 8 is a schematic drawing that shows relationships between input color data having coordinates (R, G, B) and respective vertexes S0 to S7 in an exemplary unit cube.

Specifically, some of the conversion coefficients are substituted with respective substitute conversion coefficients expressed by other ones of the conversion coefficients read from the LUT. More specifically, conversion coefficients at some of the vertexes excluding two vertexes on either end of the diagonal line placed on the gray axis of the color space are substituted. For example, if the unit cube shown in FIG. 8 is on the gray axis, the vertexes S0 and S6 are on either end of the diagonal line placed on the gray axis. Thus, for example, conversion coefficients at some of the vertexes selected from six vertexes S1 to S5 and S7, excluding the vertexes S0 and S6, are substituted.

Figure 3:
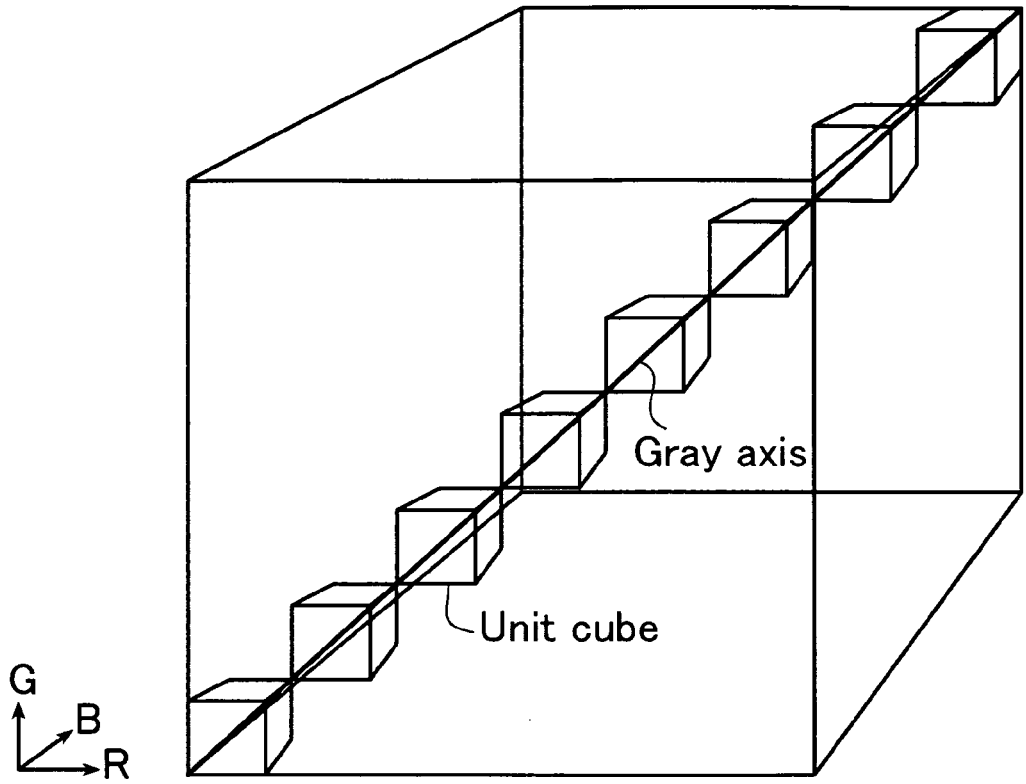
FIG. 3 is a schematic drawing that shows an exemplary LUT and unit cubes located on the diagonal line of the exemplary LUT.

Here, the input color data is positioned on the diagonal line of the unit cube on the gray axis when the input color data is positioned on the gray axis of the color space. For example, FIG. 3 shows the gray axis that connects a point having the minimum value (0) in each of R, G, and B primary colors and a point having the maximum value (1024) in each of R, G, and B primary colors. FIG. 3 also shows eight unit cubes on the gray axis having diagonal lines placed on the gray axis.

According to other various exemplary color conversion methods, some of the conversion coefficients are also substituted when it is detected that input color data is positioned within a unit cube on the gray axis, even if it is detected that the input color data is not positioned on the diagonal line of the unit cube placed on the gray axis. That is, when the input color data is positioned within the unit cube on the gray axis but not on the diagonal line placed on the gray axis, some of the conversion coefficients are substituted such that the output color data maintains continuity with another output color data converted from input color data positioned on the diagonal line of the same unit cube. For example, similar to the case described above, conversion coefficients at some of the vertexes selected from six vertexes S1 to S5 and S7, excluding the vertexes S0 and S6 on either end of the diagonal line placed on the gray axis, are substituted.

Here, input color data is positioned within a unit cube on the gray axis but not on the diagonal line placed on the gray axis when the input color data is positioned within one of eight unit cubes lined on the gray axis shown in FIG. 3 but not on the gray axis.

Figure 7:
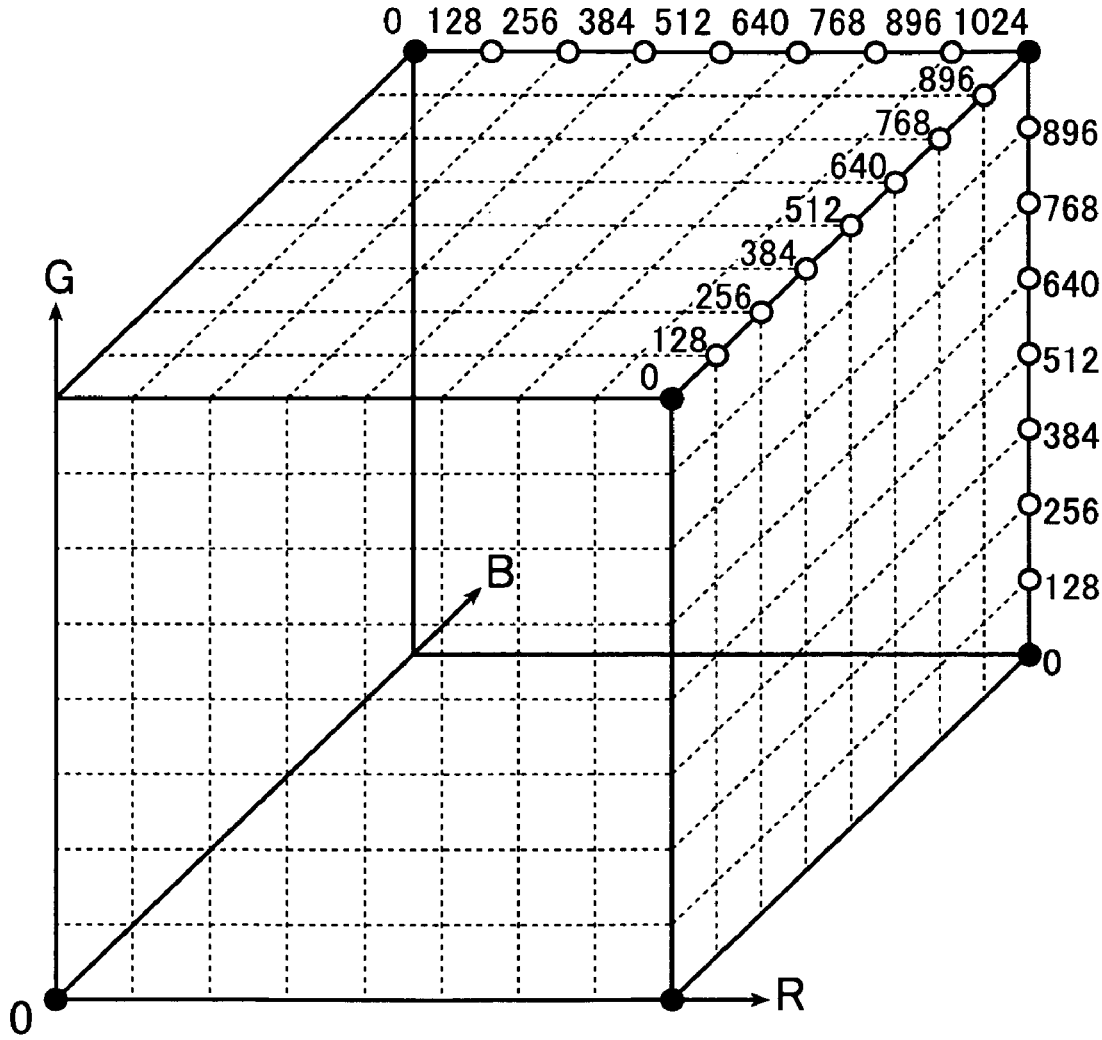
FIG. 7 Related Art
FIG. 7 is a schematic drawing that shows exemplary unit cubes in a LUT.

For example, assume that values (or luminance) of RGB primary colors are expressed by 10-bit data R[9:0], G[9:0], and B[9:0], respectively, or that the coordinate of input color data in the direction of each primary color is expressed by an integer ranging from 0 to 1023. Then, dimensions of each unit cube of the LUT may be set to 128(R)×128(G)×128(B) as shown in FIG. 7. That is, conversion coefficients may be stored in the LUT only for input color data having '0's for all lower seven bits in the value for each RGB primary color.

Here, the number of bits in input color data for each RGB primary color and the size of the unit cube (or the number of unit cubes) may be changed as required, depending on the construction of the output device, and so on. Changing the size of the unit cube changes the portion of bits of input color data subject to the interpolation.

Then, by using conversion coefficients at eight vertexes S0 to S7 of one of the unit cubes in which the input color data is positioned, some of which are substituted, and the coordinates of input color data, an interpolation is performed. Thus, input color data is converted to output color data.

Within each of the unit cubes on the gray axis of the LUT, which is represented by each of the small cubes in FIG. 3, each point or input color data on the diagonal line on the gray axis satisfies a relationship of R=G=B, where each of R, G, and B represents a value or a coordinate of the input color data in each primary color. When a diagonal line that connects the vertexes S0 and S6 is placed on the gray axis, a coordinate of input color data in each primary color becomes the minimum at the vertex S0, and a coordinate of input color data in each primary color becomes the maximum at the vertex S6. In this case, it may be desirable to make output color data corresponding to, or converted from, input color data on the diagonal line also satisfy the relationship of R=G=B.

In order to maintain the above-described relationship, conversion coefficients at the vertexes S0 and S6 of each unit cube on the gray axis are set and stored in the LUT such that output color data corresponding to input color data positioned at each of the vertexes S0 and S6 satisfies R=G=B. Here, vertexes S0 and S6 are on either end of the diagonal line placed on the gray axis. Such a setting of conversion coefficients at vertexes on the gray axis is common in the color conversion using LUT. That is, each conversion coefficient has three components for respective primary colors. By setting all three components of the conversion coefficient at each of the vertexes S0 and S6 equal with each other, output color data corresponding to input color data positioned at each of the vertexes S0 and S6 satisfies R=G=B.

Figure 4:
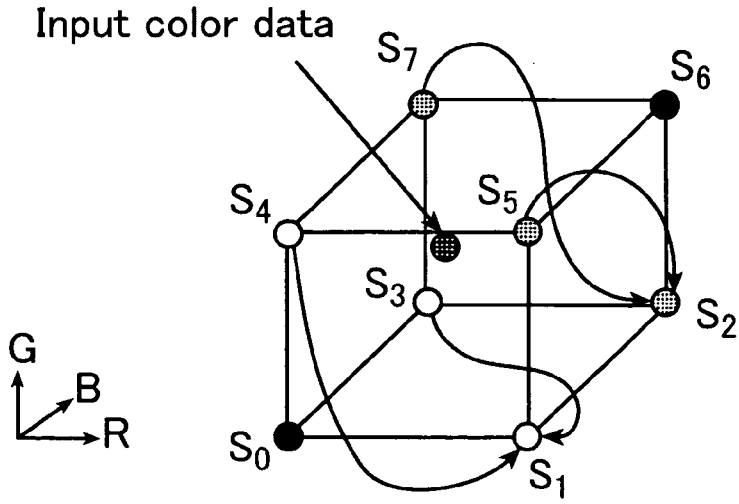
FIG. 4 is a schematic drawing that shows an exemplary substitution of a conversion coefficient at three vertexes included in each group.

Moreover, at least two of the conversion coefficients among the coefficients at six vertexes S1 to S5 and S7 are substituted with substitute conversion coefficients. For example, as shown in FIG. 4, the conversion coefficient at the vertex SI may be substituted with a substitute conversion coefficient expressed by conversion coefficients at other vertexes S3 and S4. Further, the conversion coefficient at the vertex S2 may be substituted with a substitute conversion coefficient expressed by conversion coefficients at other vertexes S5 and S7. Thereafter, the interpolation described above is performed.

The substitution is performed under a condition that values (coordinates) of output color data corresponding to input color data on the gray axis are expressed by a linear interpolation between values (coordinates) of two output color data corresponding to two input color data at the vertexes S0 and S6. As a result, because the conversion coefficients at the vertexes S0 and S6 are set such that output color data corresponding to the input color data positioned at each of the vertexes S0 and S6 satisfies R=G=B, the output color data corresponding to input color data on the gray axis also satisfies R=G=B. That is, output color data corresponding to input color data on the gray axis is positioned on the gray axis.

The substitution may be performed under a further condition that continuity between values (coordinates) of output color data corresponding to input color data positioned on the gray axis and values (coordinates) of another output color data corresponding to input color data positioned adjacent to the gray axis is maintained.

Specifically, when the input color data, whose position in the color space is specified by coordinates, is positioned within one of the unit cubes on the gray axis, six of the vertexes of the unit cube are divided into two groups. That is, six of the vertexes S1 to S5 and S7, excluding the vertexes S0 and S6 on either end of the diagonal line placed on the gray axis, are divided depending on which of the vertexes S0 and S6 is closer. Accordingly, as shown in FIG. 4, the vertexes are divided into a first group including the vertexes S1, S3, and S4 that are close to the vertex S0, and a second group including the vertexes of S2, S5, and S7 that are close to the vertex S6.

Next, at least one of the vertexes is selected from three vertexes in each group, and the conversion coefficient at the selected vertex is substituted with a substitute conversion coefficient expressed by conversion coefficients at the other vertexes in each group and conversion coefficients at the vertexes S0 and S6. Specifically, the conversion coefficient at the selected vertex is substituted such that a sum of conversion coefficients at the three vertexes in each group becomes a linear combination, such as a linear combination with a ratio of 1:2 or 2:1, of the conversion coefficients at the vertexes S0 and S6.

For example, a conversion coefficient at at least one of the vertexes in the first group including S1, S3, and S4, which are close to the vertex S0, is substituted such that S1+S3+S4=2S0+S6. Further, a conversion coefficient at at least one of the vertexes in the second group including S2, S5, and S7, which are close to the vertex S6, is substituted such that S2+S5+S7=S0 +2S6. Here, S0 to S7 in the above expressions are not used to represent the vertexes, but are used to represent the conversion coefficients at the vertexes S0 to S7.

The expressions above indicate that output color data corresponding to input color data at an intersection between a triangle in the three-dimensional color space enclosed by the three vertexes in each group and the diagonal line, which is placed on the gray axis, of the unit cube is expressed by a linear interpolation between output color data corresponding to input color data positioned at the vertexes S0 and S6 on either end of the diagonal line. As a result, it is assured that input color data positioned on the diagonal line, which is placed on the gray axis, of the unit cube is converted into gray output color data. Further, continuity between different output color data near the diagonal line, which is placed on the gray axis, is assured.

Here, the conversion coefficients to be substituted may be selected arbitrarily. However, for example, it may be desirable to select two of the conversion coefficients depending on within which of six tetrahedrons, which divide the unit cube on the gray axis such that they share the diagonal line of the unit cube that is placed on the gray axis as one of the edges, the input color data is positioned.

Figure 5:
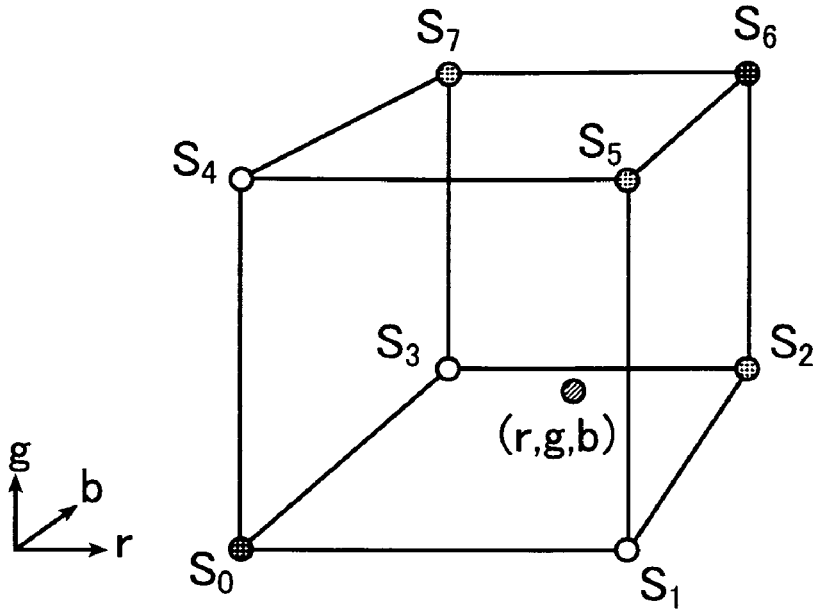
FIG. 5 is a schematic drawing that shows respective vertexes of an exemplary unit cube and a position of input color data (r, g, b) relative to the vertex S0.

In the unit cube shown in FIG. 5, where the diagonal line connecting the vertexes S0 and S6 is placed on the gray axis, six tetrahedrons, which divides the unit cube such that they share the diagonal line on the gray axis as one of the edges, include: i) a tetrahedron enclosed by the vertexes S0, S5, S1, and S6, ii) a tetrahedron enclosed by the vertexes S0, S1, S2, and S6, iii) a tetrahedron enclosed by the vertexes S0, S2, S3, and S6, iv) a tetrahedron enclosed by the vertexes S0, S3, S7, and S6, v) a tetrahedron enclosed by the vertexes S0, S7, S4, and S6, and vi) a tetrahedron enclosed by the vertexes S0, S4, S5, and S6.

For example, when the tetrahedron in which the input color data is positioned has diagonal lines of two adjoining surfaces of the unit cube as two of the edges, it is desirable to substitute conversion coefficients at the vertexes on either end of an edge of the unit cube furthest from one of the edges of the unit cube shared by the adjoining surfaces.

Next, an exemplary color conversion circuit will be explained.

Figure 1:
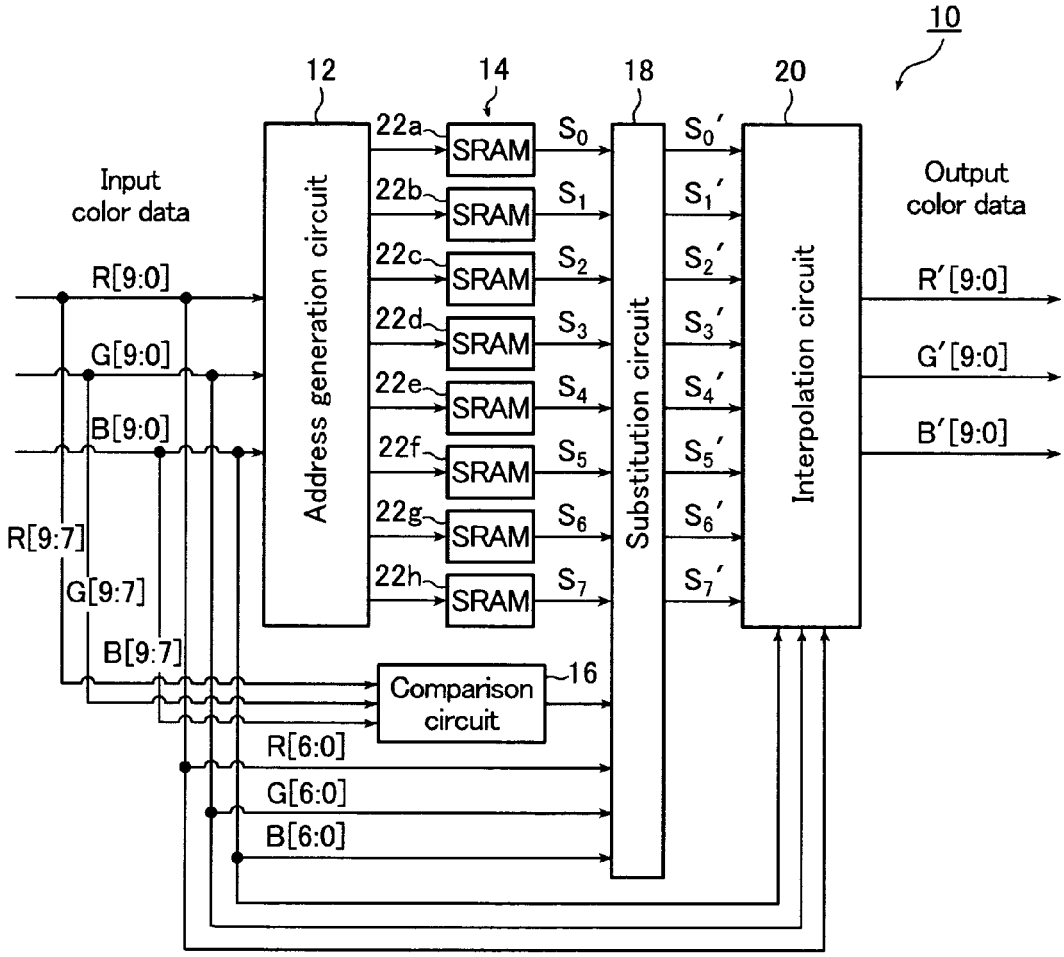
FIG. 1 is a schematic drawing that shows an exemplary construction of exemplary color conversion circuit.

FIG. 1 shows an exemplary construction of a color conversion circuit according to this invention. The exemplary color conversion circuit 10 shown in FIG. 1 includes an address generation circuit 12, a three-dimensional lookup table (LUT) 14, a comparison circuit 16, a substitution circuit 18, and an interpolation circuit 20. The exemplary color conversion circuit 10 receives 10-bit input color data for each of R, G, and B primary colors R[9:0], G[9:0], and B[9:0]. The exemplary color conversion circuit 10 outputs 10-bit output color data for each of R, G, and B primary colors R'[9:0], G'[9:0], and B'[9:0].

The address generation circuit 12 receives 10-bit input color data for each of R, G, and B primary colors R[9:0], G[9:0], and B[9:0]. The address generation circuit 12 generates, from the 10-bit input color data, eight address signals that specify each of the vertexes S0 to S7 of a unit cube in which the input color data is positioned. The eight address signals are used as addresses of eight SRAMs (static random access memories) 22*a* to 22*h* that constitute the LUT 14.

In this exemplary embodiment, LUT 14 is constructed with eight SRAMs 22*a* to 22*h* that store conversion coefficients at vertexes S0 to S7 of the unit cubes. The address signals are input from the address generation circuit 12 to the SRAMs 22*a* to 22*h*. The exemplary LUT 14 stores, in the SRAMs 22*a* to 22*h*, conversion coefficients at vertexes S0 to S7 of unit cubes that divide the three-dimensional color space. For example, as shown in FIG. 7, the three-dimensional color space may be divided into 256 unit cubes each having a dimension of 128(R)×128(G)×128(B).

SRAMs 22*a* to 22*h* that constitute the LUT 14 output conversion coefficients at vertexes S0 to S7 of the unit cube in which the input color data is positioned, which are specified by the address signals input from the address generation circuit 12. The conversion coefficients at vertexes S0 to S7 may be loaded into the SRAMs 22*a* to 22*h* from, for example, an external ROM (read only memory) through a bus, which is provided separately from the bus used for transmitting the image signal, during a start-up (power-on) period of an output device incorporating the color conversion circuit 10.

Here, it is not required to construct the LUT 14 with a plurality of SRAMs. For example, it is possible to construct the LUT 14 with a single SRAM that stores conversion coefficients at vertexes of all unit cubes. In this case, address signals that specifies eight vertexes S0 to S7 are supplied, one-by-one, from the address generation circuit 12 to the LUT 14, and the conversion coefficients stored at memory addresses specified by the address signals are output one after another. On the other hand, by constructing the LUT 14 with eight SRAMs 22*a* to 22*h*, as shown in FIG. 1, it is possible to simultaneously input eight address signals that specify eight vertexes from the address generation circuit 12, and to simultaneously output the conversion coefficients at the eight vertexes. As a result, the color conversion may be performed rapidly.

It is not required to store conversion coefficients at all vertexes of all unit cubes in each of the SRAMs, when the LUT 14 is constructed with a plurality of SRAMs. For example, when the color space is divided into a plurality of unit cubes as shown in FIG. 7, only one of conversion coefficients at oddly numbered vertexes and conversion coefficients at evenly numbered vertexes in a direction of one of the primary colors (for example, R) may be stored in each of SRAMs. That is, for example, each of SRAMs 22*a*, 22*c*, 22*e*, and 22*g* may store conversion coefficients at vertexes on the planes at R=0, 256, 512, 768 and 1024 shown in FIG. 7. On the other hand, each of SRAMs 22*b*, 22*d*, 22*f*, and 22*h* may store conversion coefficients at vertexes on the planes at R=128, 384, 640, and 896. Even in this case, eight conversion coefficients at the eight vertexes can be simultaneously output, because every unit cube has four oddly numbered vertexes and four evenly numbered vertexes.

Upper three bits for each primary color R, G, and B of input color data R [9:7], G [9:7], and B [9:7] are input to the comparison circuit 16. The comparison circuit 16 compares the upper three bits of each primary color R, G, and B and outputs a comparison result that indicates if R [9:7]=G [9:7] =B [9:7] is satisfied or not. The input color data is positioned within one of the unit cubes on the gray axis when R [9:7]=G [9:7]=B [9:7] is satisfied (i.e., when the comparison result=1). The input color data is placed within one of the unit cubes other than those on the gray axis when R [9:7]=G [9:7]=B [9:7] is not satisfied (i.e., when the comparison result=0).

Lower seven bits for each R, G, and B primary color of the input color data R[6:0], G[6:0], and B[6:0] are input to the substitution circuit 18. Further, conversion coefficients S0 to S7 are input from the LUT 14 to the substitution circuit 18, and the comparison result is input from the comparison circuit 16 to the substitution circuit 18.

When the comparison result input from the comparison circuit 16 is '1', the substitution circuit 18 substitutes some of the conversion coefficients, which are input from the LUT 14, at vertexes S0 to S7 of the unit cube in which the input color data is positioned. Specifically, the substitution circuit 18 divides six vertexes S1 to S5 and S7, excluding vertexes S0 and S6 at either end of the diagonal line placed on the gray axis, into two groups, and selects at least one of the vertexes from each of the groups. Moreover, the substitution circuit 18 substitutes conversion coefficients at the selected vertexes with substitute conversion coefficients, and outputs the conversion coefficients after the substitution S0' to S7' to the interpolation circuit 20.

On the other hand, when the comparison result input from comparison circuit 16 is '0', the substitution circuit 18 does not perform substitution of the conversion coefficients input from the LUT 14. That is, the substitution circuit 18 outputs conversion coefficients S0 to S7, without performing substitution, as conversion coefficients after the substitution S0' to S7'.

The substitute conversion coefficients are prepared to substitute some of the conversion coefficients S0 to S7 so that the conversion coefficients after the substitution S0' to S7' are produced. When the conversion coefficient(s) at at least one of the vertexes in each group is substituted, as explained above, the substitute conversion coefficient may be expressed by the conversion coefficient at other ones of the vertexes in the same group and the conversion coefficients at the vertexes S0 and S6. Specifically, the substitute conversion coefficient(s) for substituting conversion coefficient(s) at one or more of a first group vertexes S1, S3, and S4, which are close to the vertex S0, is prepared such that the conversion coefficients after the substitution satisfy S1'+S3'+S4'=2S0'+S6'. Also, the substitute conversion coefficient(s) for substituting conversion coefficient(s) at one or more of a second group vertexes S2, S5, and S7, which are close to the vertex S6, is prepared such that the conversion coefficients after the substitution satisfy S2'+S5'+S7'=S0'+2S6'.

When substituting one of the conversion coefficients in each group, for example, the conversion coefficients S2 may be substituted with 2S6+S0−S7−S5. Thereby, the relationship of S2'+S5'+S7'=2S6'+S0' can be maintained. In this example, 2S6+S0−S7−S5 is the substitute conversion coefficient that substitutes S2 (i.e., the conversion coefficient at the vertex S2). When two conversion coefficients in each group are substituted, for example, S2 may be substituted with S0+2S6 and S7 may be substituted with −S5. Thereby, the relationship of S2'+S5'+S7'=2S6'+S0' can be maintained.

Next, conversion coefficients after the substitution S0' to S7' are input from the substitution circuit 18 to the interpolation circuit 20. The interpolation circuit 20 performs interpolations using an interpolation formula including products of the coordinates of input color data in the directions of three primary colors and the conversion coefficients after the substitution S0' to S7'. Thus, the interpolation circuit 20 converts input color data R[9:0], G[9:0], B[9:0] to generate and output converted color data R'[9:0], G'[9:0], and B'[9:0].

In a conventional color conversion circuit, an interpolation circuit performs interpolations by using conversion coefficients S0 to S7 stored in a LUT at vertexes S0 to S7 of the unit cube in which the input color data is positioned. In the exemplary embodiment of color conversion circuit 10, the substitution circuit 18 is provided between the LUT 14 and the interpolation circuit 20. Accordingly, the interpolation circuit 20 performs interpolations by using conversion coefficients after the substitution S0' to S7' performed by the substitution circuit 18.

Next, an exemplary embodiment of the substitution circuit 18 will be explained.

Figure 2:
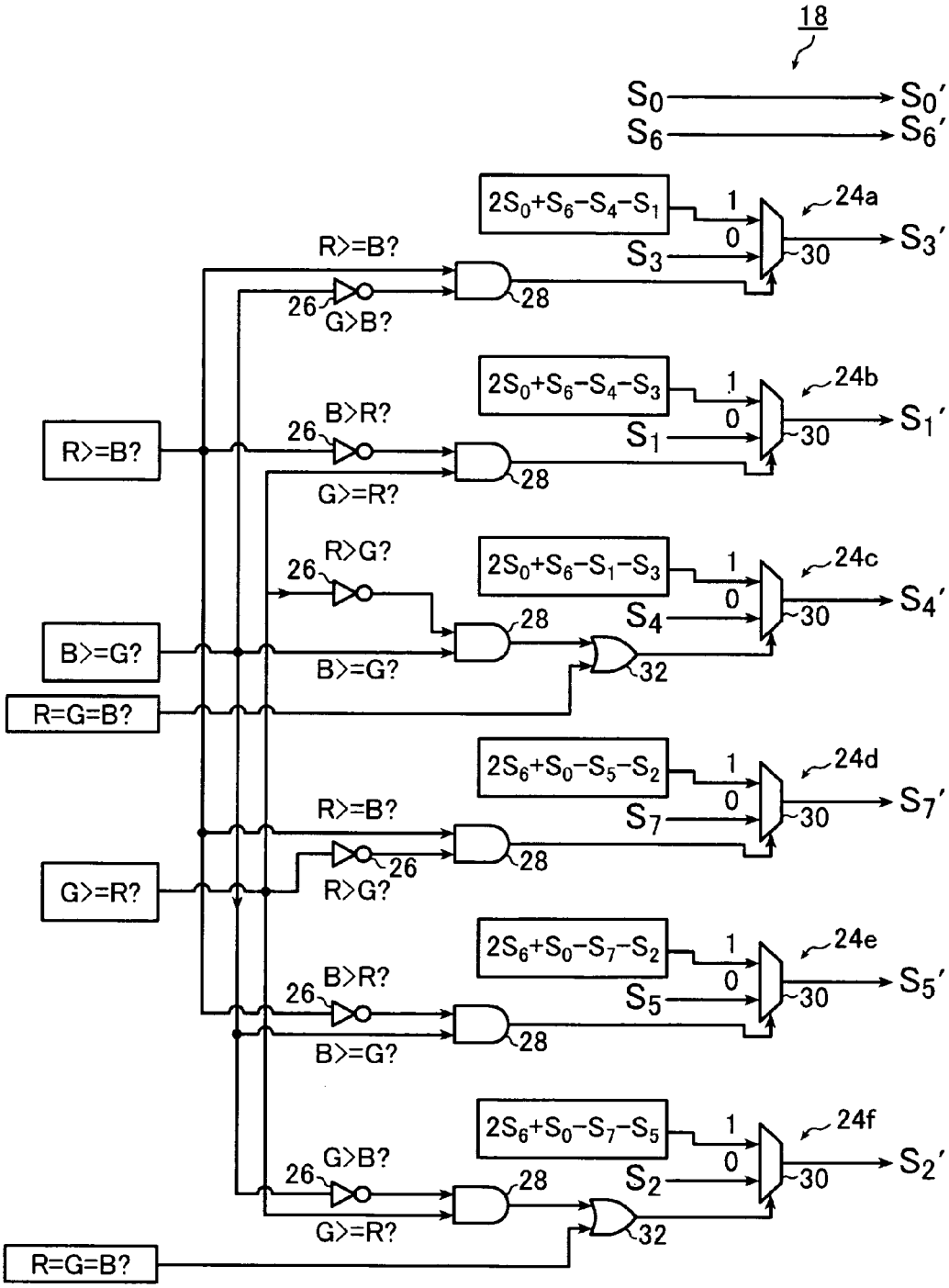
FIG. 2 is a schematic drawing that shows an exemplary construction of substitution circuit shown in FIG. 1.

FIG. 2 shows an exemplary construction of the substitution circuit 18 shown in FIG. 1. The exemplary substitution circuit 18 shown in FIG. 2 is composed of a first individual substitution circuit 24*a* for substituting the conversion coefficient at the vertex S3, a second individual substitution circuit 24*b* for substituting the conversion coefficient at the vertex S1, a third individual substitution circuit 24*c* for substituting the conversion coefficient at the vertex S4, a fourth individual substitution circuit 24*d* for substituting the conversion coefficient at the vertex S7, a fifth individual substitution circuit 24*e* for substituting the conversion coefficient at the vertex S5, and a sixth individual substitution circuit 24*f* for substituting the conversion coefficient at the vertex S2.

Here, the substitution is required when the input color data is positioned within one of the unit cubes on the gray axis. The comparison circuit 16 determines if the input color data is positioned within one of the unit cubes on the gray axis. The substitution circuit 18 performs the substitution when the comparison result supplied from the comparison circuit 16 is '1'. On the other hand, the substitution circuit 18 does not perform the substitution when the comparison result is '0'. Thus, although not shown in FIG. 2, the substitution circuit 18 actually includes a switch circuit that controls its operation depending on the comparison result. In other words, assuming that the comparison result is '1', FIG. 2 only shows a portion of the substitution circuit 18 that operates when the comparison result is '1'

Even when the input color data is positioned within one of the unit cubes on the gray axis, conversion coefficients at the vertexes S0 and S6 need not be substituted, because these vertexes are on the gray axis. Accordingly, conversion coefficients at these vertexes input from the LUT 14 to the substitution circuit 18 are output with no substitution as conversion coefficients after the substitution S0' and S6'.

In FIG. 2, 'R>=B?', 'B>=G?', and 'G>=R?' become '1' when lower seven bits of input color data input to the substitution circuit 18 have relationships of R[6:0]≧B[6:0], B[6:0]≧G[6:0], and G[6:0]≧R[6:0], respectively. Otherwise, they become '0'. Similarly, in FIG. 2, 'R=G=B?' becomes '1' when lower seven bits of input color data input to the substitution circuit 18 have a relationship of R[6:0]=G[6:0]=B[6:0]. Otherwise, 'R=G=B?' becomes '0'. As noted above, the explanation here assumes that the comparison circuit 16 detects that R[9:7]=G[9:7]=B[9:7]. Accordingly, if it is detected in the substitution circuit that R[6:0]=G[6:0]=B[6:0], then R[9:0]=G[9:0]=B[9:0]. Thus, the input color data is positioned on the gray axis.

The upper half of FIG. 2 shows individual substitution circuits 24*a*, 24*b*, and 24*c* for substituting conversion coefficients at the vertexes S3, S1, and S4, respectively, which are a group of vertexes close to the vertex S0. While, the lower half of FIG. 2 shows individual substitution circuits 24*d*, 24*e*, and 24*f* for substituting conversion coefficients at the vertexes S7, S5, and S2, respectively, which are a group of vertexes close to the vertex S6.

The first individual substitution circuit 24*a* for substituting the conversion coefficient at the vertex S3 is constructed with an inverter 26, AND circuit 28, and a multiplexer 30. The comparison result 'R>=B?' is input to the AND circuit 28. An inverted signal 'G>B?', which is produced by passing the comparison result 'B>=G?' through the inverter 26, is also input to the AND circuit 28. Moreover, a substitute conversion coefficient 2S0+S6−S4−S1 is input to the input terminal 1 of the multiplexer 30. The conversion coefficient S3 is input to the input terminal 0 of the multiplexer 30. An output signal of the AND circuit 28 is input to the selection input terminal of the multiplexer 30. The multiplexer 30 outputs the conversion coefficient S3' after the substitution.

In the first individual substitution circuit 24*a*, when R[6:0]≧B[6:0] and G[6:0]>B[6:0], i.e., when B[6:0] is the smallest among R[6:0], G[6:0], and B[6:0], the output signal of the AND circuit 28 becomes '1'. Accordingly, the substitute conversion coefficient 2S0+S6−S4−S1 is output from the multiplexer 30 as the conversion coefficient after the substitution S3'. Otherwise, the output signal of the AND circuit 28 becomes '0', and the conversion coefficient S3 is output as it is as the conversion coefficient after the substitution S3'. In other words, the substitute conversion coefficient 2S0+S6−S4−S1 is output when the input color data is positioned within a tetrahedron enclosed by the vertexes S0, S5, S1, and S6 or within a tetrahedron enclosed by the vertexes S0, S4, S5, and S6 (excluding the region on the diagonal line connecting the vertexes S0 and S6, in either case). In further other words, the substitute conversion coefficient 2S0+S6−S4−S1 is output when the vertex S3, which is located in the direction of B axis from the vertex S0, is the furthest from the input color data. Otherwise, the conversion coefficient S3 is output as it is as the conversion coefficient after the substitution S3'.

The second individual substitution circuit 24*b* for substituting the conversion coefficient at the vertex S1 has a construction similar to that of the first individual substitution circuit 24*a*. However, the comparison result 'R>=B', the inverted signal 'G>B?', the conversion coefficient S3, and the substitute conversion coefficient 2S0+S6−S4−S1 in the first individual substitution circuit 24*a* are replaced with the comparison result 'G>=R?', inverted signal 'B>R?', the conversion coefficient S1, and the substitute conversion coefficient 2S0+S6−S4−S3, respectively, in the second individual substitution circuit 24*b*.

The second individual substitution circuit 24*b* outputs the substitute conversion coefficient 2S0+S6−S4−S3 as a conversion coefficient after the substitution S1' from the multiplexer 30 when G[6:0]≧R[6:0] and B[6:0]>R[6:0], i.e., when R[6:0] is the smallest among R[6:0], G[6:0], and B[6:0]. In other words, the second individual substitution circuit 24*b* outputs 2S0+S6−S4−S3 when the input color data is positioned within a tetrahedron enclosed by the vertexes S0, S3, S7 and S6, or in a tetrahedron enclosed by the vertexes S0, S7, S4 and S6 (excluding the region on the diagonal line connecting the vertexes S0 and S6, in either case). In further other words, the second individual substitution circuit 24*b* outputs 2S0+S6−S4−S3 when the vertex S1, which is located in the direction of R axis from the vertex S0, is the furthest from the input color data. Otherwise, the conversion coefficient S1 is output as it is as the conversion coefficient after the substitution S1'.

The third individual substitution circuit 24*c* for substituting the conversion coefficient at the vertex S4 has a construction similar to that of the first individual substitution circuit 24*a*. However, the third individual substitution circuit 24*c* also includes an OR circuit 32, and output signal of the AND circuit 28 and the comparison result 'R=G=B?' are input to the OR circuit 32. An output signal of the OR circuit 32 is input to the selection input terminal of the multiplexer 30. Further, the comparison result 'R>=B', the inverted signal 'G>B?', the conversion coefficient S3, and the substitute conversion coefficient 2S0+S6−S4−S1 in the first individual substitution circuit 24*a* are replaced with the comparison result 'B>=G?', the inverted signal 'R>G?', the conversion coefficient S4, and the substitute conversion coefficient 2S0+S6−S1−S3, respectively, in the third individual substitution circuit 24*c*.

Operation of the third individual substitution circuit 24*c* when R[6:0]=G[6:0]=B[6:0] is not satisfied is similar to the operation of the first individual substitution circuit 24*a*. That is, i) when B[6:0]≧G[6:0] and R[6:0]>G[6:0], (i.e., G[6:0] is the smallest among R[6:0], G[6:0], and B[6:0]), or in other words, ii) when the input color data is positioned within a tetrahedron enclosed by the vertexes S0, S1, S2, and S6 or within a tetrahedron enclosed by the vertexes S0, S2, S3, and S6 (excluding the region on the diagonal line connecting the vertexes S0 and S6, in either case), or in further other words, iii) when the vertex S4, which is located in the direction of G axis from the vertex S0, is the furthest from the input color data, the substitute coefficient 2S0+S6−S1−S3 is output from the multiplexer 30 as the conversion coefficient after the substitution S4'. Otherwise (excluding the case when R[6:0]=G[6:0]=B[6:0] is satisfied), the conversion coefficient S4 is output as it is as the conversion coefficient after the substitution S4'.

On the other hand, the third individual substitution circuit 24*c* outputs the substitute conversion coefficient 2S0+S6−S1−S3 as the conversion coefficient after the substitution S4' when R[6:0]=G[6:0]=B[6:0] is satisfied.

Constructions and operations of the fourth individual substitution circuit 24*d* for substituting the conversion coefficient at the vertex S7, and the fifth individual substitution circuit 24*e* for substituting the conversion coefficient at the vertex S5 are similar to those of the first individual substitution circuit 24*a*. Further, construction and operation of the sixth individual substitution circuit 24*f* for substituting the conversion coefficient at the vertex S2 are similar to those of the third individual substitution circuit 24*c*. Thus, detailed explanations of those individual substitution circuits are omitted.

That is, in the fourth individual substitution circuit 24*d* for substituting the conversion coefficient at the vertex S7, i) when R[6:0]≧B[6:0] and R[6:0]>G[6:0] (i.e., when R[6:0] is the largest among R[6:0], G[6:0], and B[6:0]), or in other words, ii) when the input color data is positioned within a tetrahedron enclosed by the vertexes S0, S5, S1, and S6, or within a tetrahedron enclosed by the vertexes S0, S1, S2, and S6 (excluding the region on the diagonal line connecting the vertexes S0 and S6, in either case), or in further other words, iii) when the vertex S7, which is located in the negative direction of R axis from the vertex S6, is the furthest from the input color data, a substitute conversion coefficient 2S6+S0−S5−S2 is output from the multiplexer 30 as a conversion coefficient after the substitution S7'. Otherwise, the conversion coefficient S7 is output as it is as the conversion coefficient after the substitution S7'.

In the fifth individual substitution circuit 24*e* for substituting the conversion coefficient at the vertex S5, i) when B[6:0]≧G[6:0] and B[6:0]>R[6:0] (i.e., when B[6:0] is the largest among R[6:0], G[6:0], and B[6:0]), or in other words, ii) when the input color data is positioned within a tetrahedron enclosed by the vertexes S0, S2, S3, and S6, or within a tetrahedron enclosed by the vertexes S0, S3, S7, and S6 (excluding the region on the diagonal line connecting the vertexes S0 and S6, in either case), or in further other words, iii) when the vertex S5, which is located in the negative direction of B axis from the vertex S6, is the furthest from the input color data, the substitute conversion coefficient 2S6+S0−S7−S2 is output from the multiplexer 30 as the conversion coefficient after the substitution S5'. Otherwise, the conversion coefficient S5 is output as it is as the conversion coefficient after the substitution S5'.

In the sixth individual substitution circuit 24*f* for substituting the conversion coefficient at the vertex S2, i) when G[6:0]≧R[6:0] and G[6:0]>B[6:0] (i.e., when G[6:0] is the largest among R[6:0], G[6:0], and B[ ]6:0), or in other words, ii) when the input color data is positioned within a tetrahedron enclosed by the vertexes S0, S7, S4, and S6 or within a tetrahedron enclosed by the vertexes S0, S4, S5, and S6 (excluding the region on the diagonal line connecting the vertexes S0 and S6, in either case), or in further other words, iii) when the vertex S2, which is located in the negative direction of G axis from the vertex S6, is the furthest from the input color data, the substitute conversion coefficients 2S6+S0−S7−S5 is output from the multiplexer 30 as the conversion coefficient after the substitution S2'. Other wise (excluding the case when R[6:0]=G[6:0]=B[6:0] is satisfied), the conversion coefficient S2 is output as it is as the conversion coefficient after the substitution S2'.

On the other hand, the sixth individual substitution circuit 24*f* outputs the substitute conversion coefficient 2S6+S0−S7−S5 as the conversion coefficient after the substitution S2' when R[6:0]=G[6:0]=B[6:0] is satisfied.

As explained above, the substitution circuit 18 substitutes some of the conversion coefficients when the comparison result input from the comparison circuit 16 is '1', i.e., when the input color data is positioned within one of the unit cubes on the gray axis.

Specifically, when R[6:0]=B[6:0]=G[6:0] is satisfied, i.e., when the input color data is positioned on the gray axis of the color space, conversion coefficients at the vertexes S4 and S2 of the unit cube, in which the input color data is positioned, are substituted such that the interpolation becomes a linear interpolation between output color data corresponding to input color data positioned at the vertexes S0 and S6, which are placed on the gray axis. Thus, because the conversion coefficients at the vertexes S0 and S6 are set such that output color data corresponding to input color data positioned at each of the vertexes S0 and S6 satisfies R=G=B, it is assured that the output color data is gray.

Note that, it is not indispensable to substitute the conversion coefficients at the vertexes S4 and S2 when the input color data is positioned on the gray axis. For example, it is possible to divide six of the vertexes excluding two vertexes on either end of the diagonal line of the unit cube that is placed on the gray axis into two groups depending on which of the vertexes on either end of the diagonal line is closer. Then, one of the vertexes in each group may be arbitrary selected, and the conversion coefficients at the selected one of the vertexes may be substituted. Or, it is also possible to substitute conversion coefficients at two of the vertexes selected from each of the groups.

On the other hand, when R[6:0]=B[6:0]=G[6:0] is not satisfied, i.e., when the input color data is positioned within one of the unit cubes on the gray axis but not on the gray axis, one of the vertexes is selected from each of the groups of vertexes of the unit cube in which the input color data is positioned, and the conversion coefficients at the selected vertexes are substituted. Here, dividing six of the vertexes, excluding two vertexes on either end of the diagonal line that is placed on the gray axis, depending on which of the vertexes on either end of the diagonal line is closer, forms the groups. More specifically, one of the vertexes furthest from the input color data is selected from each of the groups.

According to another aspect of the exemplary embodiment, vertexes are selected depending on within which of six tetrahedrons, which are formed by dividing the unit cube such that each of the tetrahedrons shares the diagonal line of the unit cube that is placed on the gray axis as an edge, the input color data is positioned. And the conversion coefficients at the selected vertexes are substituted. Specifically, when the tetrahedron in which the input color data is positioned has diagonal lines of two adjoining surfaces of the unit cube as two edges, two vertexes on either end of an edge of the unit cube furthest from one of the edges of the unit cube shared by the two adjoining surfaces are selected. And the conversion coefficients at the selected vertexes are substituted.

For example, one of the tetrahedrons enclosed by the vertexes S0, S7, S4, and S6 has a diagonal line that connects the vertexes S0 and S7 and also has a diagonal line that connects the vertexes S4 and S6, as two edges. These are diagonal lines of a surface of the unit cube enclosed by the vertexes S0, S4, S7, and S3, and a surface of the unit cube enclosed by the vertexes S4, S7, S6, and S5. These two surfaces of the unit cube share the edge that connects the vertexes S4 and S7. From that edge, an edge that connects the vertexes S1 and S2 is the furthest. Accordingly, when the input color data is positioned within this tetrahedron enclosed by the vertexes S0, S7, S4, and S6, conversion coefficients at the vertexes S1 and S2 are substituted.

By substituting the conversion coefficients at the vertexes selected by such a viewpoint, continuity between different output color data corresponding to different input color data within one of the unit cubes on the gray axis is maintained. That is, continuity between first output color data corresponding to first input color data positioned on a diagonal line, which is placed on the gray axis, of a unit cube, and second output color data corresponding to second input color data position within the same unit cube but not on the diagonal line is maintained.

In some usages of color conversion, it might be sufficient if input color data positioned on the gray axis is converted in gray output color data. For such usages it would be enough to perform the substitution only when the input color data is positioned on the gray axis. In some other usages, on the other hand, it would be required to keep the continuity of output color data around the gray axis. For such usages, it would be preferable to perform the substitution when input color data is positioned within one of the unit cubes on the gray axis, even if the input color data is not positioned on the gray axis.

In addition, by appropriately setting the conversion coefficients to be substituted and the substitute conversion coefficients, it is possible to maintain the continuity not only between output color data corresponding to input color data positioned within the same unit cube on the gray axis, but also between first output color data corresponding to first input color data positioned within a unit cube on the gray axis and second output color data corresponding to second input color data positioned within a unit cube that adjoins the unit cube on the gray axis. The substitution circuit 18 shown in FIG. 2 is an exemplary substitution circuit that performs the substitution such that the continuity is maintained not only between output color data corresponding to input color positioned within the same unit cube on the gray axis, but also between the first and the second output color data corresponding to first and second input color data positioned in adjoining unit cubes.

Next, operation of the color conversion circuit 10 will be explained briefly.

When 10-bit input color data for each of R, G, and B primary colors R[9:0], G[9:0], and B[9:0] is input to the address generation circuit 12, the address generation circuit 12 generates eight address signals that specify eight vertexes S0 to S7 of a unit cube in which the input color data is positioned.

Then, SRAMs 22*a* to 22*h* that construct the LUT 14 output conversion coefficients at the vertexes S0 to S7 stored in respective addresses specified by the address signals input from the address generation circuit 12.

Moreover, comparison circuit 16 compares upper three bits for R, G, and B primary colors R[9:7], G[9:7], and B[9:7] and outputs a comparison result that indicates if R[9:7]=G[9:7]=B[9:7] is satisfied or not.

Conversion coefficients at the vertexes S0 to S7 of the unit cube in which the input color data is positioned are input to the substitution circuit 18 from the LUT 14. When the comparison result of '1' it that indicates that the input color data is positioned within one of the unit cubes on the gray axis is input from the comparison circuit 16, the substitution circuit 18 substitutes some of the conversion coefficients with substitute conversion coefficients as explained above.

The conversion coefficients S0' to S7' after the substitution are also input to the interpolation circuit 20 from the substitution circuit 18. Lower seven bits of the input color data for R, G, and B primary colors R[6:0], G[6:0], and B[6:0] are also input to the interpolation circuit 20. The interpolation circuit 20 performs interpolations using the values (coordinates) of input color data and the conversion coefficients after the substitution S0' to S7'. Accordingly, the interpolation circuit 20 generates and outputs output color data R'[9:0], G'[9:0], and B'[9:0] converted from the input color data R[9:0], G[9:0], and B[9:0].

In the exemplary color conversion circuit 10 shown in FIG. 1, lower seven bits of the input color data are input to the interpolation circuit 20. The lower seven bits of the input color data indicate a position of the input color data within the unit cube in which the input color data is position, or coordinates of the input color data relative to the vertex S0 of the unit cube. Here, S0 is a vertex nearest to the origin of the color space among the eight vertexes of the unit cube in which the input color data is positioned. That is, the coordinate of the input color data for each primary color becomes the minimum at the vertex S0.

The interpolation circuit 20 performs the interpolation by using the relative coordinates of the input color data and the conversion coefficients after the substitution S0' to S7'. On the other hand, it is also possible to input entire bits of the input color data to the interpolation circuit and to perform the interpolation by using the coordinates of the input color data in the entire color space specified by the entire bits of the input color data.

Next, exemplary results of substitutions in the substitution circuit 18 will be explained.

As previously explained with reference to FIG. 8, an internal region of the unit cube in which the input color data is positioned is divided into eight regions (rectangular parallelepipeds), each sharing the input color data (i.e., a position of the input color data within the color space specified by the coordinates) as a vertex. By using volumes of the eight divided regions (rectangular parallelepipeds) and the conversion coefficients at the vertexes of the unit cube, an interpolation is performed. The interpolation formula using the volumes of the eight rectangular parallelepipeds may be expressed by the expression (1) below, using relative values r, g, and b of the coordinates of input color data in R, G, and B primary colors relative to the vertex S0 (normalized by the length L of the grid, which become r=g=b=0 at the vertex S0 and become r=g=b=1 at the vertex S6):

$$S0r'g'b'+S1rg'b'+S2rg'b+S3r'g'b+S4r'gb'+S5rgb'+S6rgb+S7r'gb \quad (1)$$

Here, r'=1−r, g'=1−g, and b'=1−b.

The terms in expression (1) represent products of the volumes of eight divided rectangular parallelepipeds and the conversion coefficients at respective vertexes. A value or a coordinate in each primary color of output (or converted) color data is calculated by the expression (1) using components of the conversion coefficients in each primary color.

In the exemplary color conversion circuit 10 shown in FIG. 1, the interpolation circuit 20 performs interpolations using formula of expression (1) irrespective of the position of input color data within the unit cube. However, the substitution circuit 18 substitutes some of the conversion coefficients depending on the position of the input color data within the unit cube, and the interpolation circuit 20 performs the interpolation using the conversion coefficients after the substitution by the substitution circuit 18. Thus, the conversion circuit 10 shown in FIG. 1 performs the conversion of input color data depending on the position of the input color data using a single conversion formula of expression (1).

Firstly, when the input color data is positioned on the gray axis (R=G=B), conversion coefficients S2 and S4 are substituted in the substitution circuit 18 of FIG. 2. Specifically, the exemplary substitution circuit 18 substitutes conversion coefficients S2 and S4 with substitute conversion coefficients 2S6+S0−S7−S5, and 2S0+S6−S1−S3, respectively. As a result, the interpolation expression (1) is transformed into a linear expression (2) between the conversion coefficients at the vertexes S0 and S6 with a interpolation ratio determined by the coordinate r(=g=b) of the input color data.

$$r'S0+rS6 \tag{2}$$

Accordingly, input color data on the gray axis is converted into gray output color data if the conversion coefficients at the vertexes S0 and S6 are set such that input color data positioned at either of these vertexes is converted into output color data that satisfies R=G=B.

Figure 6:
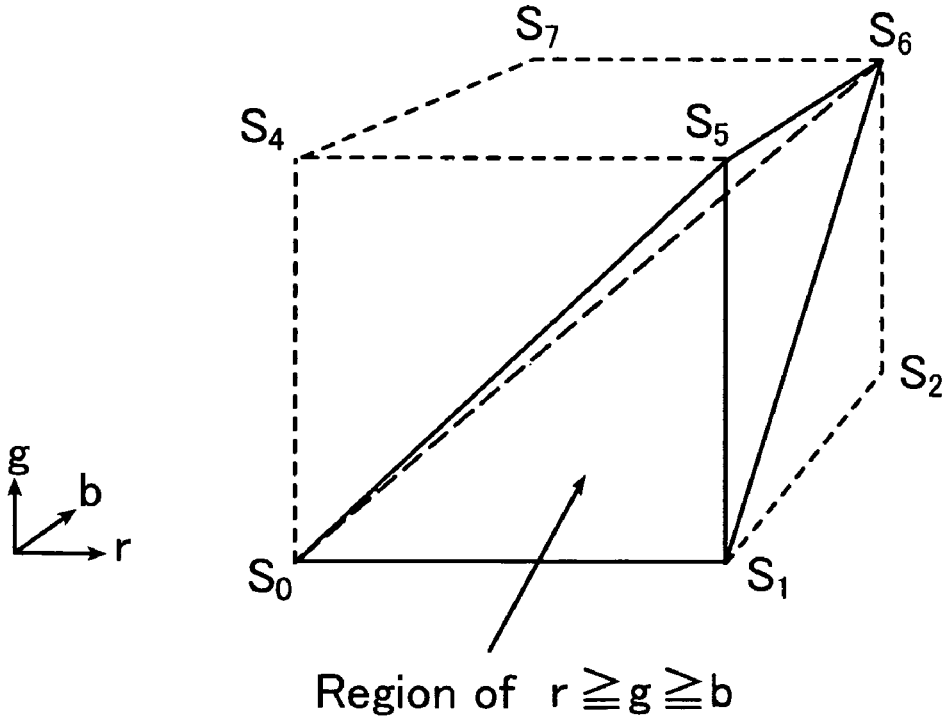
FIG. 6 is a schematic drawing that shows an area of r>=b>=g>=b in an exemplary unit cube.

Next, the conversion coefficients S3 and S7 are substituted in the substitution circuit 18 of FIG. 2 when the input color data is positioned within a tetrahedron r≧g≧b shown in FIG. 6 excluding the region on the diagonal line r=g=b. Specifically, the exemplary substitution circuit 18 substitutes conversion coefficients S3 and S7 with substitute conversion coefficients 2S0+S6−S4−S1, and 2S6+S0−S5−S2, respectively. In this case, the interpolation formula of expression (1) is transformed to the following expression (3).

$$r'(g'+b)S0+g'(r-b)S1+b(r-g)S2+r'(g-b)S4+g(r-b)S5+(r'+g)bS6 \tag{3}$$

This expression becomes the same as the expression (2) when r=g=b.

That is, when r=g=b, the interpolation expression (3) used within the tetrahedron r≧g≧b (excluding the region on the diagonal line r=g=b) becomes the same as the expression used on the gray axis (diagonal line). Thus, continuity between output color data corresponding to input color data within the tetrahedron r≧g≧b (excluding the region on the diagonal line r=g=b) and output color data corresponding to input color data on the gray axis is assured.

This tetrahedron r≧g≧b touches respective adjoining unit cubes at the surface of r=1 (the right surface in FIG. 6) and at the surface of b=0 (the front surface in FIG. 6). The expression (3) is transformed to the following expression (4) when r=1.

$$g'b'S1+g'bS2+gb'S5+gbS6 \tag{4}$$

This transformed expression (4) agrees with an expression transformed from the expression (1) assuming r=1. That is, the transformed expression (4) agrees with an expression for the interpolation on the r=1 surface of the adjoining unit cube. Note that substitution of conversion coefficients is not performed within the adjoining unit cube because the adjoining unit cube is not positioned on the gray axis. An expression transformed from the expression (3) assuming b=0 also agrees with the expression (1) on the b=0 surface of the adjoining unit cube. As a result, the output color data changes continuously at the interfaces between the adjoining unit cubes.

Next, continuity of output color data at interfaces between six tetrahedrons, which divide the unit cube such that each of the tetrahedrons shares the diagonal line connecting the vertexes S0 and S6 of the unit cube as an edge, will be discussed. For example, when r≧g=b, the expression (3) is transformed to the expression (5) below.

$$r'S0+g'(r-g)S1+g(r-g)S2+g(r-g)S5+(r'+g)gS6 \tag{5}$$

On the other hand, when r≧b≧g, the exemplary substitution circuit 18 of FIG. 2 substitutes conversion coefficients at the vertexes S4 and S7. The interpolation expression after the substitution becomes following formula (6).

$$r'(g+b')S0+(r-g)b'S1+(r-g)bS2+r'(b-g)S3+g(r-b)S5+g(r'+b)S6 \tag{6}$$

When r≧g=b, this expression (6) becomes following expression (7), which agree with an expression transformed from the expression (3), which is the interpolation expression for the region r≧g≧b.

$$r'S0+(r-g)g'S1+(r-g)gS2+g(r-g)S5+g(r'+g)S6 \tag{7}$$

This result indicates that values (or coordinates) of output color data after the conversion changes continuously with the change of values (or coordinates) of input color data across the interface between the tetrahedrons r≧g≧b and r≧b≧g.

Also, at interfaces between tetrahedrons other than the above, values (or coordinates) of output color data after the conversion change continuously with the change of values (or coordinates) of input color data, despite the fact that the exemplary substitution circuit 18 of FIG. 2 substitutes different ones of the conversion coefficients depending on in which of the tetrahedrons the input color data is positioned.

As explained above, in the exemplary color conversion circuit 10, it is assured that output color data corresponding to any input color data on the gray axis is gray in color without increasing the size of the circuitry. The output color data is assured to be gray irrespective of values stored in the three-dimensional LUT provided that the conversion coefficients at vertexes on either end of diagonal lines, which are placed on the gray axis, of unit cubes are set such that input color data positioned at the vertexes on either end of the diagonal lines are converted to output color data that satisfy R=G=B. Moreover, continuity between different output color data corresponding to different input color data positioned within the same unit cube on the gray axis is maintained. In addition, continuity between output color data corresponding to input color data positioned within a unit cube on the gray axis and output color data corresponding to input color data positioned within an adjoining unit cube is maintained.

Moreover, in the exemplary color conversion circuit 10, when input color data is positioned in a unit cube on the gray axis, some of the conversion coefficients are substituted depending on a position of the input color data within the unit cube. Nonetheless, an interpolation is performed from the conversion coefficients after the substitution using a single interpolation expression irrespective of the position of the input color data within the unit cube. In other words, an interpolation is performed using a single interpolation expression that is transformed by substituting some of the conversion coefficients depending on a position of the input color data. Thus, a plurality of interpolation circuits is not required.

In various exemplary color conversion circuits and color conversion methods, by appropriately selecting the conversion coefficients to be substituted, it becomes possible to assure that output color data converted from input color data on the gray axis is gray, or further possible to maintain continuity between different output color data, without requiring a plurality of interpolation circuits.

As described in Background Art section, various exemplary embodiments are particularly suitable for applications such as image quality improvement circuits for television sets in which both input color data and output color data are in the same RGB color space. However, applications of various exemplary embodiments are not limited to the case that both input color data and output color data are in the same color space. Various exemplary embodiments may also be used for conversions between input and output color data in various different color spaces, such as from RGB color space to CMY color space, or from CMY color space to RGB color space.

According to various exemplary color conversion circuits, it is not required to construct the LUT with SRAMs. The LUT may be constructed with various semiconductor memories such as ROMs and RAMs. Moreover, it is also possible to incorporate the address generation circuit within the LUT. In the exemplary color conversion circuit shown in FIG. 1, the address generation circuit supplies address signals to the LUT, the LUT outputs conversion coefficients stored at the addresses specified by the address signals, and the substitution circuit receives the conversion coefficients output from the LUT. However, it is also possible to construct the color conversion circuit such that the substitution circuit supplies address signals to the LUT. Further, construction of the substitution circuit is not limited to the specific example shown in FIG. 2. The interpolation circuit is not limited to a circuit that performs three-dimensional interpolations using volumes of regions (rectangular parallelepipeds) that divide the unit cube. According to various exemplary color conversion circuits, it is also possible to employ interpolation circuits that perform various multi-dimensional interpolations.

Various exemplary color conversion methods may be performed by hardware, such as the exemplary color conversion circuit 10 shown in FIG. 1. However, various exemplary color conversion methods may also be performed by software implemented in a computer. For example, programs executed in a control circuit such as a CPU (central processing unit) may constitute the functions of the address generation circuit, the comparison circuit, the substitution circuit, and the interpolation circuit. A memory device controlled by the control circuit may constitute the function of LUT.

Thus far, exemplary color conversion circuits and exemplary color conversion methods have been explained in detail with reference to specific examples. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A color conversion circuit for converting input color data into output color data, the input color data being positioned within a three-dimensional color space, which is divided in a plurality of unit cubes having a fixed dimension, at a position specified by coordinates of the input color data, the conversion circuit comprising:

a three-dimensional look-up table that stores conversion coefficients at respective vertexes of the plurality of unit cubes;

a substitution circuit that reads conversion coefficients at vertexes of one of the unit cubes in which the input color data is positioned from the three-dimensional look-up table and performs a substitution of some of the conversion coefficients read from the look-up table with substitute conversion coefficients expressed by other ones of the conversion coefficients read from the look-up table; and an interpolation circuit that performs an interpolation from the conversion coefficients after the substitution to generate converted coordinates of the output color data using volumes of rectangular parallelepipeds that divide the one of the unit cubes such that each of the rectangular parallelepipeds shares the input color data as a vertex, wherein:

each of the conversion coefficients at vertexes on either end of a diagonal line placed on a gray axis of the color space of each of the unit cubes on the gray axis has three components equal with each other, the vertexes of the each of the unit cubes on the gray axis include, in addition to the vertexes on the either end of the diagonal line, six other vertexes, and when the one of the unit cubes has the diagonal line placed on the gray axis, the substitution circuit groups the six other vertexes in two groups depending on which of the vertexes on the either end of the diagonal line is closer, selects at least one of the vertexes from each of the two groups, and performs the substitution of the conversion coefficients at the selected vertexes such that a sum of the conversion coefficients after the substitution at the vertexes in each of the two groups is expressed by a linear combination of the conversion coefficients at the vertexes on either end of the diagonal line.

2. The color conversion circuit according to claim 1, wherein, when the one of the unit cubes has the diagonal line placed on the gray axis, the substitution circuit performs the substitution such that the sum of the conversion coefficients after the substitution at the vertexes in each of the two groups is equal to a sum of two times the conversion coefficient at a closer one of the vertexes and the conversion coefficient at a further one of the vertexes on the either end of the diagonal line.

3. The color conversion circuit according to claim 1, wherein, when the one of the unit cubes has the diagonal, line placed on the gray axis, the substitution circuit selects one of the vertexes furthest from the input color data from each of the two groups, and performs the substitution of the conversion coefficients at the selected vertexes.

4. The color conversion circuit according to claim 1,wherein, when the one of the unit cubes has the diagonal, line placed on the gray axis, the substitution circuit selects at least one of the vertexes depending on in which of six tetrahedrons, which divide the one of the unit cubes such that each of the tetrahedrons shares the diagonal line of the one of the unit cubes as an edge, the input color data is positioned.

5. The color conversion circuit according to claim 4, wherein:

one of the six tetrahedrons in which the input color data is positioned has diagonal lines of two adjoining surfaces of the one of the unit cubes as two edges; and the substitution circuit selects vertexes on either end of a furthest edge of the one of the unit cubes furthest from an edge of the one of the unit cubes shared by the adjoining surfaces and substitutes the conversion coefficients at the selected vertexes.

6. A method of converting input color data into output color data, comprising:

receiving input color data positioned in a three-dimensional color space, which is divided in a plurality of unit cubes having a fixed dimension, at a position specified by coordinates of the input color data;

reading conversion coefficients at vertexes of one of the unit cubes in which the input color data is positioned;

performing a substitution of some of the read conversion coefficients with substitute conversion coefficients expressed by other ones of the read conversion coefficients; and performing an interpolation from the conversion coefficients after the substitution to generate converted coordinates of the output color data using volumes of rectangular parallelepipeds that divide the one of the unit cubes such that each of the rectangular parallelepipeds shares the input color data as a vertex, wherein:

each of the conversion coefficients at vertexes on either end of a diagonal line placed on a gray axis of the color space of each of the unit cubes on the gray axis has three components equal with each other, the vertexes of the each of the unit cubes on the gray axis include, in addition to the vertexes on the either end of the diagonal line, six other vertexes, and when the one of the unit cubes has the diagonal line placed on a on the gray axis, the substitution is performed by a substitution circuit to group the six other vertexes in two groups depending on which of the vertexes on the either end of the diagonal line is closer, select at least one of the vertexes from each of the two groups, and substitute the conversion coefficients at the selected vertexes such that a sum of the conversion coefficients after the substitution at the vertexes in each of the two groups is expressed by a linear combination of the conversion coefficients at the vertexes on the either end of the diagonal line.

7. The method according claim 6, wherein, when the one of the unit cubes has the diagonal line placed on the gray axis, the substitution is performed such that the sum of the conversion coefficients after the substitution at the vertexes in each of the two groups is equal to a sum of two times the conversion coefficient at a closer one of the vertexes and the conversion coefficient at a further one of the vertexes on the either end of the diagonal line.

8. The method according to claim 6, wherein, when the one of the unit cubes has the diagonal line placed on the gray axis, the substitution includes selecting one of the vertexes furthest from the input color data from each of the two groups so that the conversion coefficients at the selected vertexes are substituted.

9. The method according to claim 6, wherein, the one of the unit cubes has the diagonal line placed on the gray axis; the substitution includes selecting the at least one of the vertexes depending on in which of six tetrahedrons, which divide the one of the unit cubes such that each of the tetrahedrons shares the diagonal line of the one of the unit cubes as an edge, the input color data is positioned.

10. The method according to claim 9, wherein:

one of the six tetrahedrons in which the input color data is positioned has diagonal lines of two adjoining surfaces of the one of the unit cubes as two edges; and the substitution includes selecting vertexes on either end of a furthest edge of the one of the unit cubes furthest from an edge of the one of the unit cubes shared by the adjoining surfaces so that the conversion coefficients at the selected vertexes are substituted.

11. A color conversion circuit for converting input color data into output color data, the input color data being positioned within a three-dimensional color space, which is divided in a plurality of unit cubes having a fixed dimension, at a position specified by coordinates of the input color data, the conversion circuit comprising:

a three-dimensional look-up table that stores conversion coefficients of respective vertexes of the plurality of unit cubes;

a substitution circuit that reads conversion coefficients at vertexes of one of the unit cubes in which the input color data is positioned from the three-dimensional look-up table and performs a substitution of some of the conversion coefficients read from the look-up table with substitute conversion coefficients expressed by other ones of the conversion coefficients read from the look-up table; and an interpolation circuit that performs an interpolation from the conversion coefficients after the substitution to generate converted coordinates of the output color data using volumes of rectangular parallelepipeds that divide the one of the unit cubes such that each of the rectangular parallelepipeds shares the input color data as a vertex, wherein:

each of the conversion coefficients at vertexes on either end of a diagonal line placed on a gray axis of the color space of each of the unit cubes on the gray axis has three components equal with each other, the vertexes of the each of the unit cubes on the gray axis include, in addition to the vertexes on the either end of the diagonal line, six other vertexes, and when the one of the unit cubes has the diagonal line placed on the gray axis, the substitution circuit groups the six other vertexes in two groups depending on which of the vertexes on the either end of the diagonal line is closer, selects at least one of the vertexes from each of the two groups, and performs the substitution of the conversion coefficients at the selected vertexes such that a sum of the conversion coefficients after the substitution at the vertexes in each of the two groups is equal to a sum of two times the conversion coefficient at a closer one of the vertexes and the conversion coefficient at a further one of the vertexes on the either end of the diagonal line.

12. The color conversion circuit according to claim 11, wherein, when the one of the unit cubes has the diagonal line placed on the gray axis, the substitution circuit selects one of the vertexes furthest from the input color data from each of the two groups and performs the substitution of the conversion coefficients at the selected vertexes.

13. The color conversion circuit according to claim 11, wherein, when the one of the unit cubes has the diagonal line placed on the gray axis, the substitution circuit selects the at least one of the vertexes depending on in which of six tetrahedrons, which divide the one of the unit cubes such that each of the tetrahedrons shares the diagonal line of the one of the unit cubes as an edge, the input color data is positioned.

14. The color conversion circuit according to claim 13, wherein:

one of the six tetrahedrons in which the input color data is positioned has diagonal lines of two adjoining surfaces of the one of the unit cubes as two edges; and the substitution circuit selects vertexes on either end of a furthest edge of the one of the unit cubes furthest from an edge of the one of the unit cubes shared by the adjoining surfaces and substitutes the conversion coefficients at the selected vertexes.

15. A method of converting input color data into output color data, comprising:

receiving input color data positioned in a three-dimensional color space, which is divided in a plurality of unit cubes having a fixed dimension, at a position specified by coordinates of the input color data;

reading conversion coefficients at vertexes of one of the unit cubes in which the input color data is positioned;

performing a substitution of some of the read conversion coefficients with substitute conversion coefficients expressed by other ones of the read conversion coefficients; and performing an interpolation from the conversion coefficients after the substitution to generate converted coordinates of the output color data using volumes of rectangular parallelepipeds that divide the one of the unit cubes such that each of the rectangular parallelepipeds shares the input color data as a vertex, wherein:

each of the conversion coefficients at vertexes on either end of a diagonal line placed on a gray axis of the color space of each of the unit cubes on the gray axis has three components equal with each other, the vertexes of the each of the unit cubes on the gray axis include, in addition to the vertexes on the either end of the diagonal line, six other vertexes, and when the one of the unit cubes has the diagonal line placed on the gray axis, the substitution is performed by a substitution circuit to group the six other vertexes in two groups depending on which of the vertexes on the either end of the diagonal line is closer, select at least one of the vertexes from each of the two groups, and substitute the conversion coefficients at the selected vertexes such that a sum of the conversion coefficients aider the substitution at the vertexes in each of the two groups is equal to a sum of two times the conversion coefficient at a closer one of the vertexes and the conversion coefficient at a further one of the vertexes on the either end of the diagonal line.

16. The method according to claim 15, wherein, when the one of the unit cubes has the diagonal line placed on the gray axis, the substitution includes selecting one of the vertexes furthest from the input color data from each of the two groups so that the conversion coefficients at the selected vertexes are substituted.

17. The method according to claim 15, wherein, when the one of the unit cubes has the diagonal line placed on the gray axis, the substitution includes selecting the at least one of the vertexes depending on in which of six tetrahedrons, which divide the one of the unit cubes such that each of the tetrahedrons shares the diagonal line of the one of the unit cubes as an edge, the input color data is positioned.

18. The method according to claim 17, wherein:

one of the six tetrahedrons in which the input color data is positioned has diagonal lines of two adjoining surfaces of the one of the unit cubes as two edges; and the substitution includes selecting vertexes on either end of a furthest edge of the one of the unit cubes furthest from an edge of the one of the unit cubes shared by the adjoining surfaces so that the conversion coefficients at the selected vertexes are substituted.

* * * * *